US010356890B2

(12) United States Patent
Moritsugu et al.

(10) Patent No.: US 10,356,890 B2
(45) Date of Patent: Jul. 16, 2019

(54) CORE FOR HIGH-FREQUENCY ACCELERATION CAVITY, AND MANUFACTURING METHOD THEREOF

(71) Applicant: HITACHI METALS, LTD., Tokyo (JP)

(72) Inventors: Nakao Moritsugu, Osaka (JP); Katsuhiro Ogura, Osaka (JP); Masahito Yoshii, Tsukuba (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/119,029

(22) PCT Filed: Feb. 17, 2015

(86) PCT No.: PCT/JP2015/054218
§ 371 (c)(1),
(2) Date: Aug. 15, 2016

(87) PCT Pub. No.: WO2015/122526
PCT Pub. Date: Aug. 20, 2015

(65) Prior Publication Data

US 2016/0360604 A1 Dec. 8, 2016

(30) Foreign Application Priority Data

Feb. 17, 2014 (JP) ..... 2014-027718
Feb. 16, 2015 (JP) ..... 2015-027357

(51) Int. Cl.
*H01F 3/04* (2006.01)
*H01F 41/02* (2006.01)
(Continued)

(52) U.S. Cl.
CPC ..... *H05H 7/18* (2013.01); *H01F 3/04* (2013.01); *H01F 41/0226* (2013.01); *H01F 41/32* (2013.01)

(58) Field of Classification Search
None
See application file for complete search history.

(56) References Cited

U.S. PATENT DOCUMENTS 6,180,232 B1 * 1/2001 McCullough ..... C22C 47/025 174/113 R
6,246,172 B1 * 6/2001 Bizen ..... H01F 41/0226 315/5.41
(Continued)

FOREIGN PATENT DOCUMENTS

CN 102473500 A 5/2012
CN 103348420 A 10/2013
(Continued)

OTHER PUBLICATIONS

G. Mamaev "Technology for production of amorphous alloys large scale cores" IEEE Transactions 1998 P1313-1315.*
(Continued)

*Primary Examiner* — Dion Ferguson
*Assistant Examiner* — Srinivas Sathiraju
(74) *Attorney, Agent, or Firm* — Sughrue Mion, PLLC

(57) ABSTRACT

This core for a high-frequency acceleration cavity has shape formed with the single roll process by winding, with an interposed insulating layer, a Fe-based nanocrystal alloy thin strip having a roll contact surface and a free surface. The core for a high-frequency acceleration cavity is characterized in that projections having a crater-form depression are dispersed on the free surface of the Fe-based nanocrystal alloy thin strip, and the apexes of the projections are ground and blunted.

4 Claims, 2 Drawing Sheets

(51) Int. Cl.
*H01F 41/32* (2006.01)
*H05H 7/18* (2006.01)

(56) References Cited

U.S. PATENT DOCUMENTS

| | | | | |
|---|---|---|---|---|
| 6,446,702 | B1 * | 9/2002 | Murakami | B22D 11/0602 164/415 |
| 6,460,597 | B1 * | 10/2002 | McCullough | C22C 47/025 164/100 |
| 6,505,673 | B1 * | 1/2003 | Abuaf | B22C 7/06 164/138 |
| 6,544,357 | B1 * | 4/2003 | Hehmann | C23C 14/14 148/420 |
| 7,449,074 | B2 * | 11/2008 | Branagan | B22D 11/0622 148/403 |
| 7,506,566 | B2 * | 3/2009 | Decristofaro | H01F 1/15308 83/13 |
| 8,497,027 | B2 * | 7/2013 | Branagan | B32B 3/12 148/403 |
| 9,035,643 | B2 * | 5/2015 | Yoshimori | G01R 15/202 324/117 H |
| 2011/0108166 | A1 * | 5/2011 | Branagan | B32B 3/12 148/403 |
| 2011/0293463 | A1 * | 12/2011 | Branagan | C22C 38/002 420/14 |
| 2012/0154084 | A1 * | 6/2012 | Yoshizawa | C22C 38/02 335/297 |
| 2013/0139929 | A1 * | 6/2013 | Francoeur | C21D 8/1272 148/111 |
| 2013/0314198 | A1 | 11/2013 | Yoshizawa et al. | |
| 2014/0097286 | A1 * | 4/2014 | Francoeur | B65H 19/1852 242/431 |
| 2014/0283957 | A1 * | 9/2014 | Zhou | C22C 45/00 148/541 |
| 2015/0307973 | A1 * | 10/2015 | Branagan | C22C 38/002 420/14 |
| 2016/0319409 | A1 * | 11/2016 | Theisen | C21D 1/62 |
| 2017/0011829 | A1 | 1/2017 | Moritsugu et al. | |

FOREIGN PATENT DOCUMENTS

| | | | |
|---|---|---|---|
| CN | 106030732 | A | 10/2016 |
| EP | 0 695 812 | A1 | 2/1996 |
| EP | 0 982 977 | A2 | 3/2000 |
| JP | 57-39509 | A | 3/1982 |
| JP | 61-246318 | A | 11/1986 |
| JP | 9-167699 | A | 6/1997 |
| JP | 2000-138099 | A | 5/2000 |

OTHER PUBLICATIONS

PCT/IB/338, with attached International Preliminary Report on Patentability and Written Opinion (PCT/ISA/237), received in counterpart PCT/JP2015/054218.

International Search Report for PCT/JP2015/054218 dated Mar. 31, 2015 [PCT/ISA/210].

Office Action dated Nov. 8, 2017 issued from the State Intellectual Property Office of P. R. China in Chinese Application No. 201580009128.7.

Extended European Search Report dated Sep. 25, 2017 in European Patent Application No. 15749341.2.

Communication dated Jun. 5, 2018 issued from the State Intellectual Property Office of the P.R.C. in corresponding Chinese application No. 201580009128.7.

Communication dated Aug. 31, 2018, from the Japanese Patent Office in corresponding Japanese application No. 2015-027357.

* cited by examiner

CORE FOR HIGH-FREQUENCY ACCELERATION CAVITY, AND MANUFACTURING METHOD THEREOF

CROSS REFERENCE TO RELATED APPLICATIONS

This application is a National Stage of International Application No. PCT/JP2015/054218 filed Feb. 17, 2015, claiming priority based on Japanese Patent Application Nos. 2014-027718 filed Feb. 17, 2014 and 2015-027357 filed on Feb. 16, 2015, the contents of all of which are incorporated herein by reference in their entirety.

TECHNICAL FIELD

The present invention relates to a core for a high-frequency acceleration cavity used for an accelerator for accelerating charged particles, and also to a manufacturing method thereof.

BACKGROUND ART

As a core for a high-frequency acceleration cavity used for an accelerator for accelerating charged particles, a core using an Fe-based nanocrystalline soft magnetic alloy ribbon has been employed for its higher saturation flux density as compared with ferrite and also low loss (Patent Document 1).

Patent Document 2 describes a core for a high-frequency acceleration cavity using an Fe-based nanocrystalline soft magnetic alloy ribbon with a gap formed therein.

As an Fe-based nanocrystalline alloy ribbon for forming the above core, for example, the above Patent Document 2 discloses an alloy ribbon having a thickness of 10 to 30 μm (claim 3). Meanwhile, in terms of productivity, an Fe-based nanocrystalline soft magnetic alloy ribbon is typically cast to a thickness of more than 15 μm and used.

However, for a core for a high-frequency acceleration cavity, further reduction of losses has been required. As a method for reducing the eddy current loss, which is one of the losses in a core, generally, reduction of the thickness of an alloy ribbon is known.

Patent Document 3 describes a reforming method for improving the magnetic characteristics, according to which the surface of an amorphous alloy is mechanically ground or chemically ground. Specifically, it is described that the roll non-contact surface is ground 1 μm or less, preferably 0.5 μm or less.

Incidentally, a core for a high-frequency acceleration cavity is produced by winding and laminating an amorphous alloy ribbon for an Fe-based nanocrystalline alloy, followed by a heat treatment at a temperature not lower than the crystallization temperature. At this time, it is necessary to ensure insulation between layers of the alloy ribbon. Therefore, usually, a silica powder or alumina powder is applied to one side of a continuously cast alloy ribbon and then dried to form an insulating film, thereby increasing the degree of insulation between layers of the alloy ribbon.

PRIOR ART DOCUMENTS

Patent Documents

Patent Document 1: JP-A-9-167699
Patent Document 2: JP-A-2000-138099
Patent Document 3: JP-A-57-39509

SUMMARY OF THE INVENTION

Problems to be Solved by the Invention

As described above, in order to further reduce losses in a core, specifically for reducing the eddy current loss, in place of a conventional Fe-based amorphous alloy ribbon for an Fe-based nanocrystalline alloy produced to a thickness of more than 15 μm, an alloy ribbon having a reduced thickness of about 13 μm has been manufactured, followed by the formation of an insulating film, winding, and then a heat treatment for forming a nanocrystalline alloy, thereby producing a core.

However, as a result of the production of a core using an alloy ribbon having a thickness of about 13 μm, which was originally expected to reduce the eddy current loss for its small thickness, it has turned out that the expected effect cannot be obtained.

Further, as a result of full investigation, it has turned out that unlike the conventional case where the thickness is more than 15 μm, layers of the alloy ribbon are not sufficiently insulated, causing short-circuiting extremely frequently. In a core for a high-frequency acceleration cavity, a high-voltage, high-frequency wave is applied to a coil wound around the core, whereby a high voltage is generated also in the alloy ribbon of the core. Therefore, when the insulation between layers of the alloy ribbon is insufficient, the layers of the alloy ribbon are short-circuited and electrically communicated, whereby the eddy current loss increases, presumably resulting in increased losses in the core.

Here, a method for evaluating the degree of insulation in a core composed of a wound and laminated alloy ribbon will be described. A core is produced as follows: one end of an alloy ribbon having an insulating film made of a silica powder previously formed on one side thereof is fixed to a cylindrical inner core made of an insulating material such as resin, and then a predetermined length Lr (e.g., 200 m) is wound and laminated under a predetermined tension (e.g., 15 N). First, the direct current resistance value Ru per unit length of the alloy ribbon in the longitudinal direction is previously determined. The alloy ribbon length Lr wound around the core and the direct current resistance Rr between two end portions of the innermost circumference and outermost circumference of the alloy ribbon are measured, whereby the ratio of the actual direct current resistance between the two end portions relative to the direct current resistance of the alloy ribbon in the case where layers of the alloy ribbon are completely insulated, that is, $Rr/(Ru \times Lr) \times 100(\%)$, can be evaluated to evaluate the degree of insulation in the core.

Although the degree of insulation is ideally 100%, in the case where the alloy ribbon thickness is about 18 μm, in reality, the silica insulating film partially comes off, resulting in the lack of an insulating film. Accordingly, the adjacent alloy ribbons come in contact with each other in some parts, resulting partial short-circuiting. As a result, the value is usually 80 to 90%.

However, in the case where the alloy ribbon thickness was about 13 μm, as a result of evaluation, the degree of insulation was less than 50%, suggesting that layers of the wound and laminated alloy ribbon were in frequent electrical contact with each other. In the case where the degree of insulation is less than 50%, not only that the eddy current loss cannot be reduced as expected, but also that when it is actually used for a core for a high-frequency acceleration cavity, a high voltage may be generated between alloy ribbons, causing short-circuiting, resulting in damage to the core.

As a result of full investigation of the contact portion described above, in an alloy ribbon having a thickness of about 13 μm, a large number of crater-like projections with a concave were observed on the principal surface on one side of the alloy ribbon. Meanwhile, in an alloy ribbon having a thickness of about 18 μm, almost no crater-like projections with a concave were observed. Accordingly, it is surmised that an insulating film is hardly formed on the crater-like projections with a concave, and such projections contact and electrically communicate with the adjacent alloy ribbon; as a result, the degree of insulation decreases, and the eddy current loss increases, resulting in increased losses.

In addition, an alloy ribbon is produced by a single-roll process. It has also turned out that the surface on which the crater-like projections with a concave are formed is the opposite surface to the surface that contacts the cooling roll (hereinafter referred to as "roll contact surface"). Hereinafter, the opposite surface is referred to as "free surface".

The present invention has been accomplished against the above background, and an object thereof is to provide a low-loss core for a high-frequency acceleration cavity and also a manufacturing method thereof.

Means for Solving the Problems

The present inventors have examined how to suppress the increase in losses due to crater-like projections formed on the free surface of an Fe-based amorphous alloy ribbon for an Fe-based nanocrystalline alloy, without impairing the excellent magnetic characteristics that an Fe-based nanocrystalline alloy originally has. Then, they have found that it is effective to grind and blunt the portion forming the top part of a crater-like projection, and thus accomplished the present invention.

Here, "blunting" means to grind the top part of a crater-like projection to make it smoother, and is not limited to a specific shape or specific surface conditions. The same applies hereinafter.

<1> Core for High-Frequency Acceleration Cavity

This invention is a core for a high-frequency acceleration cavity, having a shape formed by winding an Fe-based nanocrystalline alloy ribbon by a single-roll process with an insulating layer interposed, the Fe-based nanocrystalline alloy ribbon having a roll contact surface and a free surface, wherein the free surface of the Fe-based nanocrystalline alloy ribbon has dispersed thereon crater-like projections with a concave, and the projections each have a top part that is ground and blunted.

In the present invention, it is preferable that the Fe-based nanocrystalline alloy ribbon has a thickness of 10 to 15 μm.

<2> Method for Manufacturing Core for High-Frequency Acceleration Cavity

This invention is a method for manufacturing a core for a high-frequency acceleration cavity, including:

(1) a step of producing an Fe-based amorphous alloy ribbon for an Fe-based nanocrystalline alloy ribbon by a single-roll process;

(2) a step of bring a free surface of the Fe-based amorphous alloy ribbon into contact with a rotating peripheral surface of a cylindrical grindstone, thereby pressure-grinding and blunting top parts of crater-like projections with a concave dispersed on the free surface;

(3) a step of forming an insulating layer on the free surface and/or roll contact surface of the Fe-based amorphous alloy ribbon;

(4) a step of winding the Fe-based amorphous alloy ribbon having the insulating layer formed thereon; and (5) a step of heat-treating the wound Fe-based amorphous alloy ribbon to cause nanocrystallization, thereby giving an Fe-based nanocrystalline alloy ribbon.

Effect of the Invention

According to the present invention, the increase in losses due to crater-like projections dispersed on the free surface of an Fe-based amorphous alloy ribbon for an Fe-based nanocrystalline alloy can be suppressed. Accordingly, a low-loss core can be provided.

MODE FOR CARRYING OUT THE INVENTION

The Fe-based amorphous alloy ribbon to be used for the core of the invention is an alloy ribbon that has a nanocrystalline structure after a crystallization heat treatment and is produced by a single-roll process. In a single-roll process, a molten metal is discharged from a nozzle onto a cooling roll and rapidly cooled, and the solidified alloy ribbon is separated from the cooling roll to perform continuous casting.

When the thickness of the alloy ribbon is 15 μm or less, a large number of crater-like projections with a concave about 20 to 50 μm in diameter and 5 to 10 μm in height are formed on the free-surface side of the alloy ribbon. It is presumed that the formation of such projections is attributable to the involvement of air at the time of discharging a molten metal from a nozzle onto a cooling roll. In order to reduce the thickness of the alloy ribbon 1, it is necessary to reduce the amount of liquid discharged from the nozzle, reduce the gap between the nozzle and the cooling roll, etc. It is considered that the involvement of air is promoted by such changes in condition setting.

Figure 2:
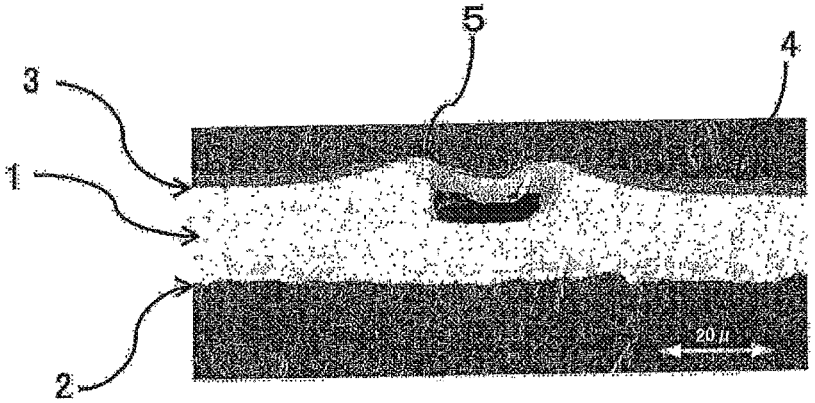
FIG. 2 is a cross-sectional photograph of a crater-like projection with a concave on the free surface of an alloy ribbon.
Figure 4:
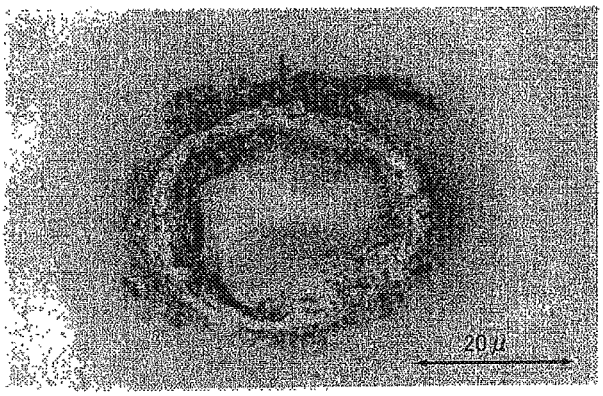
FIG. 4 is a plane photograph of a crater-like projection with a concave on the free surface of an alloy ribbon.

FIG. 2 shows a cross-sectional photograph of one of the crater-like projections with a concave. In addition, FIG. 4 shows a plane photograph of the projection 5. Each figure shows the projection with its top part not being ground and blunted.

Figure 5:
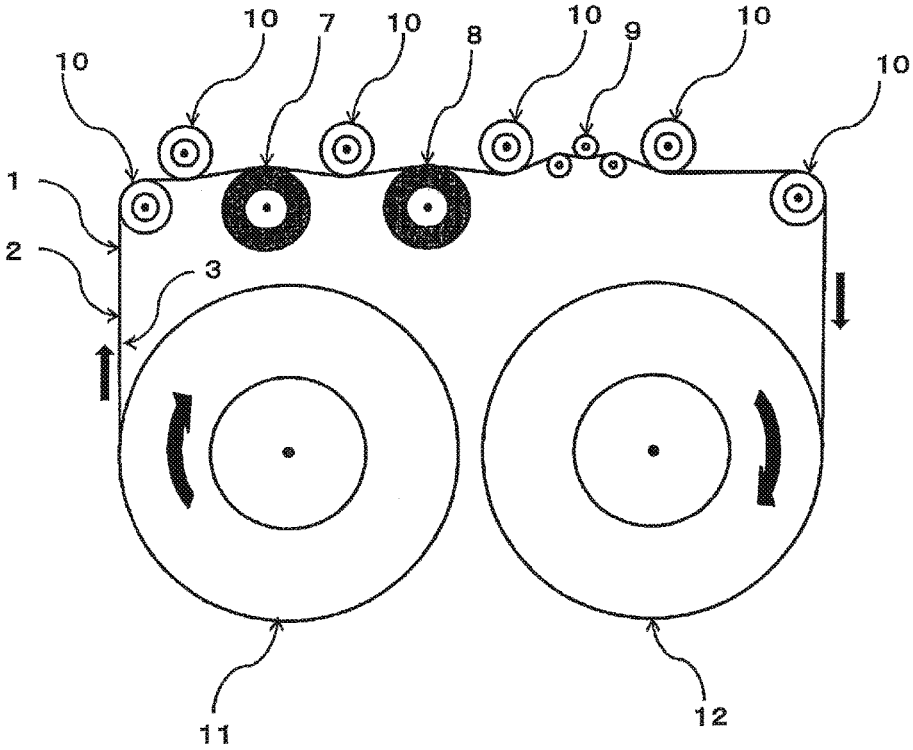
FIG. 5 schematically describes a method for grinding and blunting the top part of a crater-like projection with a concave on the free surface of an alloy ribbon in the present invention.

FIG. 5 shows a schematic diagram of a facility for grinding and blunting the top part of the projection 5 according to the present invention. An unwind reel 11 is a roll of the Fe-based amorphous alloy ribbon 1 after casting by a single-roll process. A wind-up reel 12 is a roll of the alloy ribbon 1 after the completion of the grinding and blunting treatment step.

A cylindrical grindstone 7 has the function of grinding and blunting the top part of the crater-like projection with a concave 5. A cleaner roll 8 has the function of removing the abrasive powder attached to the alloy ribbon surface after grinding and blunting. A tension adjustment roll 9 allows a predetermined tension to act on the running alloy ribbon 1 so that grinding and blunting are suitably performed. A large number of guide rolls 10 are placed in suitable positions so that the alloy ribbon 1 can run along the predetermined pathway.

Next, with reference to FIG. 5, the step of grinding and blunting the top part of the crater-like projection with a concave 5 formed on the alloy ribbon 1 will be described.

After casting, the Fe-based amorphous alloy ribbon 1 wound up on the unwind reel 11 is unwound while controlling the running with the plurality of guide rolls 10. While controlling the tension as predetermined with the tension adjustment roll 9, the alloy ribbon surface (free surface 3) is ground while rotating the cylindrical grindstone 7 (grindstone roll), whereby the top part of the crater-like projection with a concave 5 can be easily ground.

In addition, the alloy ribbon surface after grinding and blunting has attached thereto the abrasive powder, and it is thus preferable to remove the abrasive powder with the cleaner roll 8.

Here, the overall width of the cylindrical grindstone 7 (grindstone roll) contacts the free surface 3 of the alloy ribbon 1 across the width of the surface. However, by adjusting the tension, only the top part of the crater-like projection with a concave 5 is selectively pressurized, and thus only the top part of the crater-like projections with a concave 5 can be almost selectively ground and blunted.

As the cylindrical grindstone 7, a cylindrical electrodeposited grindstone may be used. It may be produced by Ni-plating a cylindrical base metal with an Ni plating solution containing a diamond powder or CBN (cubic boron nitride) powder of No. #50 to 15000 (particle size: 297 to 1 μm).

In order to efficiently grind and blunt the top parts of crater-like projections with a concave, it is suitable to use a grindstone having electrodeposited thereon a diamond powder or CBN powder of No. #1000 to #1500 (particle size: 15 to 10 μm) and perform grinding at a peripheral speed of 400 to 600 m/min. The above grindstone has durability and is resistant to clogging, and thus has excellent productivity and is preferable.

Figure 1:
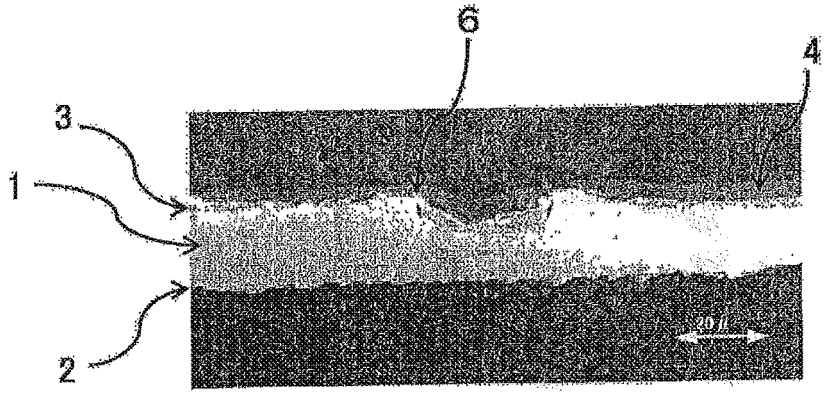
FIG. 1 is a cross-sectional photograph of a crater-like projection with a concave on the free surface of an alloy ribbon in the present invention, after grinding and blunting the top part.
Figure 3:
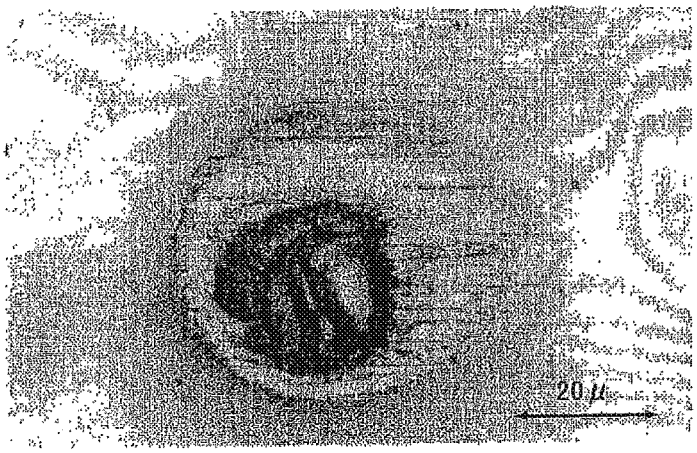
FIG. 3 is a plane photograph of a crater-like projection with a concave on the free surface of an alloy ribbon in the present invention, after grinding and blunting the top part.

FIG. 1 shows a cross-sectional photograph of the portion where the top part of the crater-like projection with a concave 5 has been ground and blunted under the above conditions. FIG. 3 shows a plane photograph of the portion where the top part of the projection 5 has been ground and blunted. As a result of grinding the top part of the projection 5, the edge is blunted and becomes smoother. The degree of grinding may be suitably determined.

By grinding and blunting the top part of the projection 5, the possibility that the edge of the top part of the projection 5 comes in direct contact with the roll-contact-surface side of the alloy ribbon 1 laminated thereon, thereby causing short-circuiting, can be reduced. As a result, sufficient insulation can be provided between layers of an Fe-based nanocrystalline alloy ribbon having a small thickness, such as 13 μm. In addition, also in the case of a relatively large thickness, such as 18 μm, the surface of the free surface 3 may have formed thereon top parts of crater-like projection with a concave 5, and thus the grinding and blunting treatment of the invention is effective.

In order to reduce the eddy current loss, the thickness of the alloy ribbon is preferably 15 μm or less, and more preferably 14 μm or less. However, after a molten metal alloy solidifies on the cooling roll to form an alloy ribbon, when the alloy ribbon is continuously separated from the cooling roll, mechanical strength that prevents the alloy ribbon itself from breaking is required. For this reason, it is preferable that the thickness is 10 μm or more.

As the Fe-based amorphous alloy ribbon for the Fe-based nanocrystalline alloy ribbon of the present invention, an alloy containing Fe as a main component and also containing, as essential elements, at least one element selected from Cu and Au and at least one element selected from Ti, V, Zr, Nb, Mo, Hf, Ta, and W is suitable. Examples thereof include the Fe—Cu—Nb—Si—B type disclosed in JP-B-4-4393, as well as Fe—Cu—Nb—Zr—Si—B type, Fe—Cu—Nb—Zr—B type, Fe—Mo—B type, Fe—Nb—B type, Fe—Zr—B type, Fe—Cu—Zr—B type, and Fe—Nb—Al—Si—B type.

When heat-treated at a temperature not lower than the crystallization temperature, such an alloy forms a soft magnetic alloy ribbon having a nanocrystalline structure, in which bcc-Fe solid solution crystals having an average particle size of 100 nm or less occupy 50% or more of the structure.

After the removal of the abrasive powder with the cleaner roll 8, the alloy ribbon 1 with the top part of the projection 5 being ground and blunted shown in FIG. 3 is once wound up on the wind-up reel 12. After once wound up, the alloy ribbon 1 is newly subjected to a treatment step of applying an insulating layer 4. As a device for forming the insulating layer 4, it is preferable to use a known roll coater, such as a gravure coater.

That is, it is possible that the wind-up reel 12 having the alloy ribbon 1 thereon is set in a roll coater as an unwind reel, and an insulating layer 4 is applied to the surface of the alloy ribbon 1.

The interlayer insulating film is formed by applying and drying silica, alumina, or the like. In this case, a method that allows an insulating film to be continuously formed with high efficiency is a method in which the alloy ribbon is immersed in an alcohol solution containing a metal alkoxide, followed by drying to form the film, a method in which the alloy ribbon is immersed in a solution having dispersed therein a silica powder or the like, followed by drying, or the like.

After the insulating layer 4 is applied and dried, the alloy ribbon 1 is wound up again on the wind-up reel 12.

In this embodiment, an example of forming the insulating layer on the free surface 3 has been described. However, it is also possible to form the insulating layer on the roll contact surface 2. In addition, it is also possible that the insulating layer is formed on each of the roll contact surface 2 and the free surface 3. Considering the cost and the ease of the treatment steps, it is preferable that the insulating layer is formed only on the free surface 3.

EXAMPLES

Comparative Example 1

A molten metal composed of, in at %, Cu: 1%, Nb: 3%, Si: 15.5%, B: 6.5%, and the remainder: Fe and inevitable impurities (alloy mass: 40 kg) was rapidly cooled by a single-roll process, thereby giving an about 17,000-m-long Fe-based amorphous alloy ribbon having a width of 25 mm and a thickness of 13 μm.

In order to examine the conditions of crater-like projections with a concave on the free surface of the obtained alloy, at an arbitrary position in the length direction, three points including a central portion and two end portions in the width direction of the alloy ribbon were taken as three fields in total, each having a field size of 5 mm×50 mm, and observed under a metallographical microscope. As a result, ten crater-like projections with a concave were seen in the three fields.

Next, a silica insulating film was applied. The alloy ribbon was passed through a liquid having a silica powder suspended in IPA (isopropyl alcohol) and then dried, thereby forming a silica insulating film of 1.5 to 3 μm on one side (free surface) of the alloy ribbon.

A 200-m-long part of the alloy ribbon having the silica insulating film formed thereon was wound around a roll core made of resin having an inner diameter of 180 mm, and the degree of insulation was evaluated. The result was 41%.

The alloy ribbon having the silica insulating film formed thereon was wound to produce a toroidal core having an inner diameter of 28 mm and an outer diameter of 45 mm, and maintained in a nitrogen atmosphere at a maximum holding temperature of 580° C. for 20 minutes to form a nanocrystalline alloy. Subsequently, two conductive wires having a diameter of 0.5 mm were each wound around the core once, and the loss was measured under the following conditions: frequency: 100 kHz, excitation magnetic flux density: 200 mT. The result was 200 kW/m$^3$.

The alloy ribbon having the silica insulating film formed thereon was wound to produce a toroidal core shaped for an acceleration cavity and having an inner diameter of 245 mm, an outer diameter of 800 mm, and a height of 25 mm, and maintained in a nitrogen atmosphere at a maximum holding temperature of 580° C. for 20 minutes to form a nanocrystalline alloy. Subsequently, using LCR Meter 4285A manufactured by Agilent, the shunt impedance Rp was measured at frequencies of 0.5 MHz, 1 MHz, 5 MHz, and 10 MHz (oscillating output voltage OSC=0.5 V, coil: copper plate of 0.05 mm thick×28 mm wide, 1 turn).

The μp'·Q·f value (GHz) can be determined from Rp using the following relational expression. The μp'·Q·f value is used as an index that allows for the comparison of core characteristics even in the case where the core shape (inner diameter, outer diameter, etc.) is different.

$$Rp=\mu\cdot t\cdot\ln(b/a)\mu p'\cdot Q\cdot f$$

Here, μ0: magnetic permeability in vacuum, t: core height, a: core inner diameter, b: core outer diameter, μp': complex magnetic permeability (real part) in the parallel equivalent circuit, Q: Q value of the core, f: frequency.

In the core for a high-frequency acceleration cavity, it is considered desirable that the shunt impedance Rp is high, that is, the μp'·Q·f value is high.

The μp'·Q·f value (GHz) of the above core for an acceleration cavity at each frequency was 3.4 (0.5 MHz), 4.1 (1 MHz), 6.4 (5 MHz), and 7.6 (10 MHz).

Comparative Example 2

An alloy having a mass of 40 kg with the same composition as in Comparative Example 1 was melted at a temperature not lower than the melting point, and then the molten metal was discharged from a nozzle onto a cooling roll by single-roll process to a width of 25 mm and a thickness 18 μm, thereby giving an about 12,200-m-long alloy ribbon.

In order to examine the conditions of crater-like projections with a concave on the free surface of the obtained alloy, at an arbitrary position in the length direction, three points including a central portion and two end portions in the width direction of the alloy ribbon were taken as three fields in total, each having a field size of 5 mm×50 mm, and observed under a metallographical microscope. As a result, only one crater-like projection with a concave was seen in the three fields.

Next, a silica film was applied. The alloy ribbon was passed through a liquid having a silica powder suspended in IPA and then dried, thereby forming a silica insulating film of 1.5 to 3 μm on one side (free surface) of the alloy ribbon.

A 200-m-long part of the alloy ribbon having the silica insulating film formed thereon was wound around a roll core made of resin having an inner diameter of 180 mm, and the degree of insulation was evaluated. The result was 87%.

A toroidal core was produced in the same manner as in Comparative Example 1, and the loss was measured. The result was 227 to 236 kW/m$^3$.

An alloy having a mass of 40 kg with the same composition as in Comparative Example 1 was melted at a temperature not lower than the melting point, and then the molten metal was discharged from a nozzle onto a cooling roll by single-roll process to a width of 35 mm and a thickness 18 μm, thereby giving an alloy ribbon.

In the same manner as in Comparative Example 1, a silica insulating film was formed on the alloy ribbon, then wound to produce a toroidal core shaped for an acceleration cavity and having an inner diameter of 245 mm, an outer diameter of 800 mm, and a height of 35 mm, and maintained in a nitrogen atmosphere at a maximum holding temperature of 580° C. for 20 minutes to form a nanocrystalline alloy. Subsequently, the shunt impedance Rp at each frequency was measured in the same manner as in Comparative Example 1, and the μp'·Q·f value (GHz) was calculated. The μp'·Q·f value (GHz) at each frequency was 3.2 (0.5 MHz), 3.8 (1 MHz), 6.0 (5 MHz), and 7.2 (10 MHz).

Example 1

With respect to 500 m of the 16,900-m-long alloy ribbon produced above in Comparative Example 1, the free surface was ground using the device shown in FIG. 5 provided with a cylindrical grindstone having electrodeposited thereto a diamond powder (grindstone roll) (#1000). The diameter of the cylindrical grindstone was 60 mm, and the rotation speed was 2,500 rpm. Thus, the peripheral speed was 450 m/min. In addition, during grinding, a tension of 30 N/m was applied to the alloy ribbon, and the contact distance between the cylindrical grindstone and the alloy ribbon was 4.2 mm (8° in terms of angle). The cross-section of the portion where the top part of a crater-like projection with a concave on the free surface was ground and blunted (after the abrasive powder was removed with a cleaner roll) was observed. The result is shown in FIG. 1. FIG. 2 shows the cross-section of a crater-like projection with a concave on the free surface before grinding and blunting. It can be seen that as compared with FIG. 2, the top part of the crater-like projection with a concave on the surface is ground and blunted in FIG. 1.

With respect to 500 m of the alloy ribbon, after forming a silica insulating film in the same manner as in the comparative examples, a 200-m-long part was wound around a roll core made of resin having an inner diameter of 180 mm, and the degree of insulation was evaluated. The result was 85%. As compared with Comparative Example 1 in which the top parts of crater-like projections with a concave on the free surface are not ground and blunted, the degree of insulation is twice or more larger. In addition, as compared with Comparative Example 2 in which the thickness of the alloy ribbon is 18 μm, and there are almost no crater-like projections with a concave, the degree of insulation is only 2% lower, that is, almost equal.

Further, a toroidal core was produced in the same manner as in Comparative Example 1, and the loss was measured. The result was 166 to 177 kW/m$^3$. As compared with Comparative Example 1 in which the top parts of crater-like projections with a concave on the free surface are not ground and blunted, the loss value is 11 to 17% lower. Meanwhile, as compared with Comparative Example 2 in which the thickness of the alloy ribbon is 18 μm, the loss is reduced by about 25%.

Using the alloy ribbon having formed thereon a silica insulating film described in Example 1, the alloy ribbon was wound to produce a toroidal core shaped for an acceleration cavity and having an inner diameter of 245 mm, an outer diameter of 800 mm, and a height of 25 mm, and maintained in a nitrogen atmosphere at a maximum holding temperature of 580° C. for 30 minutes to form a nanocrystalline alloy. Subsequently, the shunt impedance Rp at each frequency was measured in the same manner as in Comparative Example 1, and the μp'·Q·f value (GHz) was calculated. The μp'·Q·f value (GHz) at each frequency was 4.2 (0.5 MHz), 4.9 (1 MHz), 7.1 (5 MHz), and 8.4 (10 MHz).

The calculation results of the μp'·Q·f values (GHz) of Comparative Example 1, Comparative Example 2, and Example 1 are shown in (Table 1).

TABLE 1

| | Alloy ribbon thickness (μm) | Grinding | μp' · Q · f value (GHz) 0.5 MHz | 1 MHz | 5 MHz | 10 MHz |
|---|---|---|---|---|---|---|
| Comparative Example 1 | 13 | Not performed | 3.4 | 4.1 | 6.4 | 7.6 |
| Comparative Example 2 | 18 | Not performed | 3.2 | 3.8 | 6 | 7.2 |
| Example 1 | 13 | Performed | 4.2 | 4.9 | 7.3 | 8.4 |

From Table 1, as a result of the comparison of μp'·Q·f values, at a frequency of 0.5 MHz, the value of Example 1 is 0.8 larger than Comparative Example 1 and 1.0 larger than Comparative Example 2. At a frequency of 1 MHz, the value of Example 1 is 0.8 larger than Comparative Example 1 and 1.1 larger than Comparative Example 2. At a frequency of 5 MHz, the value of Example 1 is 1.1 larger than Comparative Example 1 and 1.3 larger than Comparative Example 2. At a frequency of 10 MHz, the value of Example 1 is 0.8 larger than Comparative Example 1 and 1.2 larger than Comparative Example 2. It was confirmed that when the μp'·Q·f value (GHz) is relatively large, excellent characteristics are exhibited in the actual application for high-frequency acceleration cavities.

Comparative Example 3

In Example 1, the top parts of crater-like projections with a concave on the free surface were ground using a device provided with a cylindrical grindstone (grindstone roll) (#1000), while in Comparative Example 3, not only the top parts of crater-like projections with a concave, but also the entire free surface was ground. However, in Comparative Example 3, it was not possible to grind the entire surface with the #1000 cylindrical grindstone because of clogging. Therefore, a cylindrical grindstone having electrodeposited thereto a diamond powder of #400 was used. A toroidal core was produced in the same manner as in Comparative Example 1, and the loss was measured. The result was 194 to 198 kW/m$^3$. Therefore, it was confirmed that when the entire surface is ground, the loss increases by about 15% as compared with the case of grinding only the top parts of crater-like projections with a concave.

As the cause for the loss increase, it is presumed that as a result of changes in the surface conditions of the free surface of the alloy ribbon, the silica insulating film became more likely to be separated, causing the deterioration of the interlayer insulating properties.

DESCRIPTION OF REFERENCE SIGNS

1: Fe-based amorphous alloy ribbon
2: Roll contact surface
3: Free surface
4: Silica insulating film
5: Crater-like projection with a concave
6: Ground and blunted portion
7: Cylindrical grindstone (grindstone roll)
8: Cleaner roll
9: Tension adjustment roll
10: Guide roll
11: Unwind reel
12: Wind-up reel

The invention claimed is:

1. A method for manufacturing a core, comprising:

(1) a step of producing an Fe-based amorphous alloy ribbon for an Fe-based nanocrystalline alloy ribbon by a single-roll process;

(2) a step of bringing a free surface of the Fe-based amorphous alloy ribbon into contact with a rotating peripheral surface of a cylindrical grindstone, thereby pressure-grinding and blunting top parts of crater-like projections with a concave dispersed on the free surface of the Fe-based amorphous alloy ribbon;

(3) a step of forming an insulating layer on the free surface and/or roll contact surface of the Fe-based amorphous alloy ribbon;

(4) a step of winding the Fe-based amorphous alloy ribbon having the insulating layer formed thereon; and (5) a step of heat-treating the wound Fe-based amorphous alloy ribbon to cause nanocrystallization, thereby giving the Fe-based nanocrystalline alloy ribbon, wherein the core has a shape formed by winding the Fe-based nanocrystalline alloy ribbon by the single-roll process with the insulating layer interposed, the Fe-based nanocrystalline alloy ribbon has a roll contact surface and a free surface, wherein the free surface of the Fe-based nanocrystalline alloy ribbon has dispersed thereon crater-like projections with a concave formed by the single-roll process, and the crater-like projections each have only a top part that is ground and blunted.

2. The method for manufacturing the core according to claim 1, wherein the Fe-based amorphous alloy ribbon has a thickness of 10 to 15 μm.

3. The method for manufacturing the core according to claim 1, wherein in the pressure-grinding and blunting step a predetermined tension acts on the Fe-based amorphous alloy ribbon.

4. The method for manufacturing the core according to claim 2, wherein in the pressure-grinding and blunting step a predetermined tension acts on the Fe-based amorphous alloy ribbon.

* * * * *